US006179237B1

(12) United States Patent
David et al.

(10) Patent No.: US 6,179,237 B1
(45) Date of Patent: Jan. 30, 2001

(54) COILING DEVICE FOR WIRE ROD

(75) Inventors: Siegfried David; Karl Keller, both of Hilchenbach (DE)

(73) Assignee: SMS Schloemann-Siemag AG, Dusseldorf (DE)

( * ) Notice: Under 35 U.S.C. 154(b), the term of this patent shall be extended for 0 days.

(21) Appl. No.: 09/327,989

(22) Filed: Jun. 8, 1999

(30) Foreign Application Priority Data

Jun. 19, 1998 (DE) ..... 198 27 349

(51) Int. Cl.[7] ..... B65H 54/00; B21C 47/02

(52) U.S. Cl. ..... 242/361

(58) Field of Search ..... 242/361, 361.1, 242/361.2, 361.3, 361.4, 361.5

(56) References Cited

U.S. PATENT DOCUMENTS 4,242,892 * 1/1981 Wykes et al. ..... 242/361
5,312,065 * 5/1994 Shore et al. ..... 242/361

* cited by examiner

*Primary Examiner*—John M. Jillions
(74) *Attorney, Agent, or Firm*—Herbert Dubno; Andrew Wilford

(57) ABSTRACT

An apparatus for coiling a continuously arriving wire has a main support rotatable about an axis and having mounting formations and a head carried on the support and having mounting formations engaging the support mounting formations. A guide tube is fixed on the head and has an intake end aligned with the axis and closely juxtaposed with the main support and an outlet end axially spaced from the intake end and opening tangentially offset from the axis. A releasable fastener engaged between the support and the head presses the head mounting formations against the support mounting formations.

13 Claims, 1 Drawing Sheet

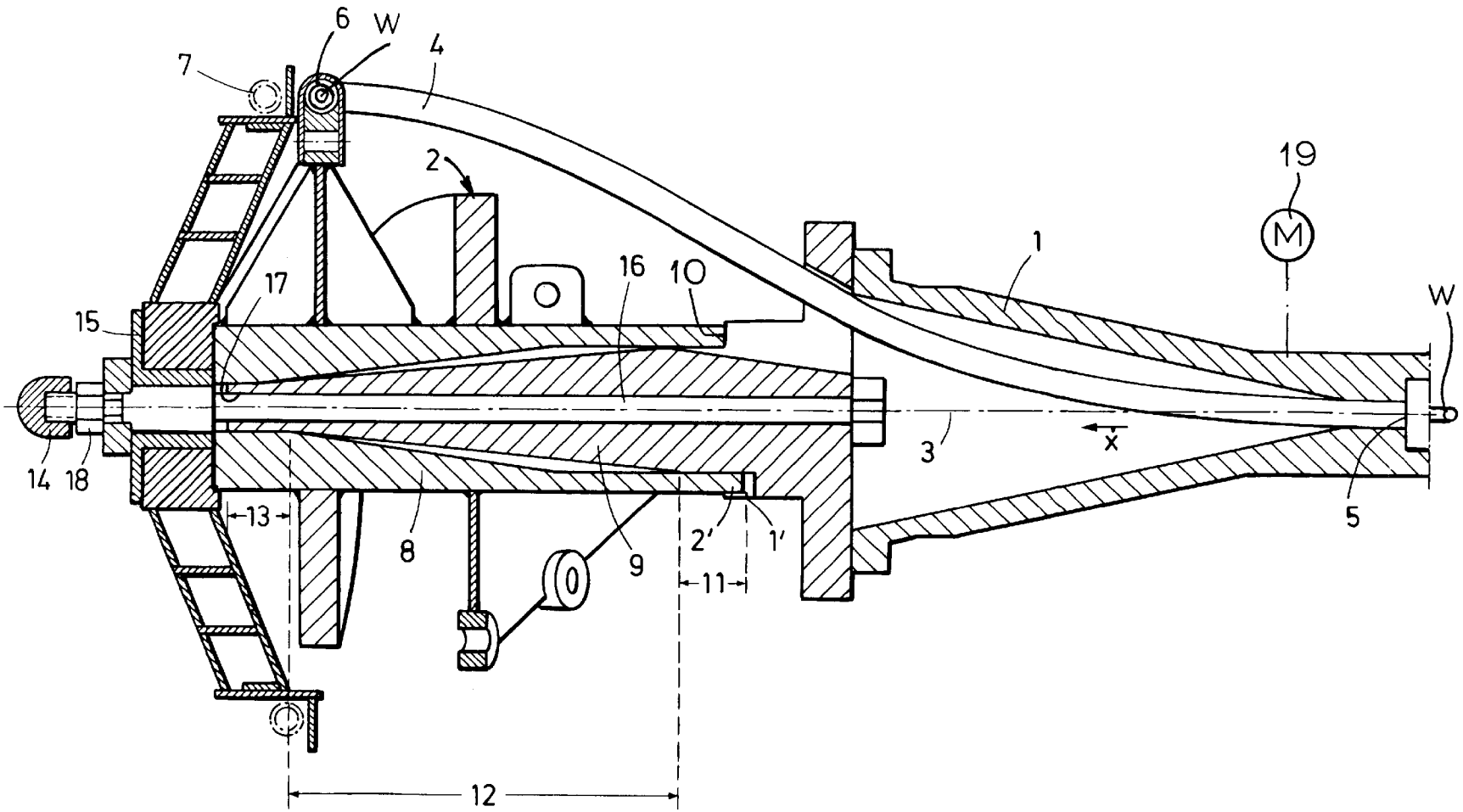
W
5
19
x
1
3
1'
2'
11
10
16
9
12
2
4
W
6
8
17
13
7
15
18
14

COILING DEVICE FOR WIRE ROD

FIELD OF THE INVENTION

The present invention relates to a coiling device for wire rod. More particularly this invention concerns an apparatus which receives wire rod in a straight line and forms it into a succession of turns.

BACKGROUND OF THE INVENTION

Wire or rod (hereinafter termed "wire" only) is formed at high speed in a rolling or drawing mill and is delivered in straight condition to a coiler that forms it into a succession of large-diameter turns that it deposits on a surface, normally a conveyor of some type. Thence the coiled wire is moved through subsequent treatment steps such as heat treatment, descaling, pickling, or simply cooling. It is critical that the wire be deposited in uniformly shaped and spaced coils so that the subsequent treatment stage is effective.

The typical coiling system comprises a guide tube twisted in three dimensions and having an upstream end opening axially in line with an axis about which the tube is rotated and a downstream end which opens at a location radially offset from the axis and directed generally tangentially. The straight wire is fed into the upstream end of the guide tube as it is rotated about its axis so that as the wire passes through the tube it is bent into an arcuate shape and will fall in a coil when leaving the downstream end of the tube.

In U.S. Pat. No. 5,312,065 issued May 17, 1994 to Shore et al such a device is shown that basically comprises a rotor head or body carrying the spiral guide tube and that is secured via a flange to a basic support that is rotated about the axis and to whose center the incoming wire is fed. The tube extends freely upstream along the axis from the rotor body to a position with its upstream end aligned axially with the outlet of the infeed tube.

Since such a system is subject to considerable wear, as a steel wire is being pulled through the guide tube and simultaneously deformed, it is necessary to periodically service and/or replace the head structure. This is an onerous job entailing considerable down time while the rotor body is disconnected, and the way the guide tube is mounted leaves it open to damage as the rotor body is moved.

OBJECTS OF THE INVENTION

It is therefore an object of the present invention to provide an improved wire rod coiling apparatus.

Another object is the provision of such an improved wire rod coiling apparatus which overcomes the above-given disadvantages, that is which is simple to service.

SUMMARY OF THE INVENTION

An apparatus for coiling a continuously arriving wire has according to the invention a main support rotatable about an axis and having mounting formations and a head carried on the support and having mounting formations engaging the support mounting formations. A guide tube is fixed on the head and has an intake end aligned with the axis and closely juxtaposed with the main support and an outlet end axially spaced from the intake end and opening tangentially offset from the axis. A releasable fastener engaged between the support and the head presses the head mounting formations against the support mounting formations.

This system has the advantage that the entire head structure, including the guide tube, can be balanced before it is mounted on the support. Thus as it rotates there will be no throw or vibration. Furthermore release of the single fastener allows the head to be changed, minimizing down time for servicing.

According to the invention the fastener is a bolt which is elastically deformable. Thus the bolt holds the head on the support under prestress and can compensate for thermal expansion and contraction. In addition the bolt has a protective end cap. The support in accordance with the invention is formed centered on the axis with a spindle having axially offset inner and outer ends constituting the support mounting formations and the head is formed centered on the axis with a sleeve having axially offset inner and outer ends complementarily engaging the respective inner and outer ends of the support and constituting the head formations. More particularly the spindle is formed with a longitudinally throughgoing passage and the fastener is a bolt centered on the axis, extending axially through the passage, and bearing axially in one direction on the support and axially in the opposite direction on the head.

The outer ends according to the invention are of cylindrical shape and relatively small diameter and the inner ends are of cylindrical shape and relatively large diameter. Furthermore the sleeve and spindle are out of engagement with each other between the inner and outer ends. This ensures excellent centering of the head on the support.

The spindle has a hardened outer surface to protect it from corrosion and wear. It can be chromium-plated or nitrided so that it will have a long service life.

The spindle extends generally a full length of the head. In addition axially interfitting coupling formations rotationally couple the head to the support. Furthermore in accordance with the invention the head is provided with a helical extension tube having a tangentially open inlet end aligned with the outlet end of the guide tube and a tangentially oppositely open outlet end.

BRIEF DESCRIPTION OF THE DRAWING

The above and other objects, features, and advantages will become more readily apparent from the following description, reference being made to the accompanying drawing whose sole figure is a partly diagrammatic axial section through the apparatus according to the invention.

SPECIFIC DESCRIPTION

As seen in the drawing a wire W is fed along a horizontal axis 3 to a support 1 rotated by a motor 19 about this axis 3. Fixed to this support 1 as will be described below is a head 2, axially interengaging teeth 1' and 2' on the support 1 and head 2 rotationally coupling them together. Alternatively the two parts 1 and 2 could have complementary polygonal coupling formations centered on the axis. A guide tube 4 fixed on the head 2 has an upstream intake end 5 that opens axially upstream and a downstream outlet end 6 that opens tangentially offset from the axis on the head 2. A helical extension tube 7 may also be fixed to this head 2 so that as the wire W issues from the end 6 it is constrained to form at least one generally circular loop before it exits the tube 7 and is laid on an unillustrated horizontal conveyor underneath the device.

The head 2 has a center sleeve 8 whose interior is centered on the axis 3 and formed by a small-diameter cylindrical downstream portion, a frustoconical middle portion, and a large-diameter cylindrical upstream portion. The support 1 has a central tubular spindle 9 also centered on the axis 3 and formed by a large-diameter cylindrical upstream portion, a frustoconical middle portion, and a small-diameter downstream portion. The sleeve 8 and spindle 9 fit complementarily together at an upstream region 11 and a downstream region 13 but are out of contact with each other at a central region 12. Thus the head 2 is perfectly centered on the support 1 and cannot move radially relative to this support 1. The outer surface of the spindle 9 is hardened, for instance by being nitrided or coated with chromium, so any wear will be on the head 2.

The spindle 9 is formed on the axis 3 with a throughgoing bore 17 receiving a bolt 16 having a head 19 bearing axially on the support 1 and at its opposite end a nut 18 bearing via a T-washer 15 on the head 2 so as to press the support 2 against a shoulder 10 of the support 1. A protective cap 14 on the threaded outer end of the bold 16 protects it against damage from the wire W. The bolt 16 is elastically deformable, that is it is limitedly axially stretchable so as to be under tension when the nut 18 is tightened so as to hold the two parts 1 and 2 together under prestress.

Thus under normal circumstances the head 2 and tube 4 are solidly mounted on the support 1, the axial centering being ensured by the coaxial engagement at the regions 11 and 13 and the angular coupling ensured by the interfit of the formations 1' and 2'. Nonetheless to remove the entire head 2 and tube 4, all that is needed is to lift off the cap 14, which can be integrated into the nut 18 as a cap nut, unscrew the nut 18, and pull off the entire head 2 and tube 4. The removed structure can be as easily replaced with another such head, and the apparatus can be restarted with minimal down time.

We claim:

1. An apparatus for coiling a continuously arriving wire, the apparatus comprising:

a main support rotatable about an axis and having mounting formations;

a head carried on the support and having mounting formations engaging the support mounting formations;

a guide tube fixed on the head and having an intake end aligned with the axis and closely juxtaposed with the main support and an outlet end axially spaced from the intake end and opening tangentially offset from the axis; and a releasable fastener engaged between the support and the head and pressing the head mounting formations against the support mounting formations, the head and guide tube being removable as a single niece from the support when the fastener is released.

2. The coiling apparatus defined in claim 1 wherein the fastener is a bolt.

3. The coiling apparatus defined in claim 2 wherein the bolt is elastically deformable.

4. The coiling apparatus defined in claim 1 wherein the bolt has a protective end cap.

5. The coiling apparatus defined in claim 1, further comprising axially interfitting coupling formations rotationally coupling the head to the support.

6. The coiling apparatus defined in claim 1 wherein the head is provided with a helical extension tube having a tangentially open inlet end aligned with the outlet end of the guide tube and a tangentially oppositely open outlet end.

7. An apparatus for coiling a continuously arriving wire, the apparatus comprising:

a main support rotatable about an axis and formed centered on the axis with a spindle having axially offset inner and outer ends constituting support mounting formations;

a head carried on the support and formed centered on the axis with a sleeve having axially offset inner and outer ends complementarily engaging the respective inner and outer ends of the support and constituting head formations;

guide tube fixed on the head and having an intake end aligned with the axis and closely juxtaposed with the main support and an outlet end axially spaced from the intake end and opening tangentially offset from the axis; and a releasable fastener engaged between the support and the head and pressing the head mounting formations against the support mounting formations.

8. The coiling apparatus defined in claim 7 wherein the spindle is formed with a longitudinally throughgoing passage and the fastener is a bolt centered on the axis, extending axially through the passage, and bearing axially in one direction on the support and axially in the opposite direction on the head.

9. The coiling apparatus defined in claim 7 wherein the outer ends are of cylindrical shape and relatively small diameter and the inner ends are of cylindrical shape and relatively large diameter.

10. The coiling apparatus defined in claim 7 wherein the sleeve and spindle are out of engagement with each other between the inner and outer ends.

11. The coiling apparatus defined in claim 7 wherein the spindle has a hardened outer surface.

12. The coiling apparatus defined in claim 7 wherein the spindle extends generally a full length of the head.

13. An apparatus for coiling a continuously arriving wire, the apparatus comprising:

a main support rotatable about an axis and with an axially extending spindle having a small-diameter and cylindrical outer end centered on the axis and a large-diameter and cylindrical inner end spaced from the outer end and also centered on the axis, the spindle being formed with an axially throughgoing passage;

a head carried on the support and having a mounting sleeve with a cylindrical end fitting with and complementary to the support outer end and an opposite end fitting with and complementary to the support inner end;

axially interengaged coupling formations on the head and support rotationally coupling the head to the support;

a guide tube fixed on the head and having an intake end aligned with the axis and closely juxtaposed with the main support and an outlet end axially spaced from the intake end and opening tangentially offset from the axis; and a bolt extending along the axis and having one end bearing axially on the support and an opposite end bearing axially on the head.

* * * * *